US007055409B2

(12) United States Patent
Hsien

(10) Patent No.: US 7,055,409 B2
(45) Date of Patent: Jun. 6, 2006

(54) SOCKET WRENCH FOR RATCHET WHEEL SOCKETS

(76) Inventor: Chin-Ching Hsien, 235 Chung - Ho Box 8-24, Taipei (TW)

( * ) Notice: Subject to any disclaimer, the term of this patent is extended or adjusted under 35 U.S.C. 154(b) by 136 days.

(21) Appl. No.: 10/795,856

(22) Filed: Mar. 9, 2004

(65) Prior Publication Data

US 2005/0199102 A1 Sep. 15, 2005

(51) Int. Cl.
*B25B 13/46* (2006.01)

(52) U.S. Cl. ..... 81/60; 81/61; 81/177.8

(58) Field of Classification Search ..... 81/60, 81/61, 62, 63, 177.8, 177.9
See application file for complete search history.

(56) References Cited

U.S. PATENT DOCUMENTS 4,463,632 A * 8/1984 Parke ..... 81/177.9
4,901,608 A * 2/1990 Shieh ..... 81/177.8
5,794,496 A * 8/1998 Arnold ..... 81/63.2
6,341,543 B1 * 1/2002 Hsieh ..... 81/63.2
6,745,650 B1 * 6/2004 Chang ..... 81/177.8
2003/0188608 A1 * 10/2003 Hsien ..... 81/177.8

* cited by examiner

*Primary Examiner*—David B. Thomas
*Assistant Examiner*—Alvin J. Grant

(57) ABSTRACT

A socket wrench for ratchet wheel sockets, comprises a handle having a recess at a first terminal thereof, an empty space between a pair of ear portions defining the recess, each of the ear portions being provided with an axial hole; a drive piece for retaining a ratchet wheel on which a ratchet wheel socket can be mounted, the recess of the handle being capable of receiving a pivotal portion of the drive piece; and a retaining pin for connecting the handle and the drive piece by being inserted though the axial holes of the ear portions and the pivotal portion of the drive piece. The drive piece can be folded about the retaining pin to change the angular position of the drive piece with respect to the handle.

5 Claims, 12 Drawing Sheets

SOCKET WRENCH FOR RATCHET WHEEL SOCKETS

FIELD OF THE INVENTION

The present invention relates to socket wrenches for ratchet wheel sockets, and more particularly to a socket wrench for ratchet wheel sockets having a foldable ratchet wheel drive piece.

DESCRIPTION OF THE PRIOR ART

In one prior art about the socket wrench device includes a socket wrench and a ratchet wheel socket. One terminal of the wrench is provided with a drive piece, and another terminal forms a handle portion. The drive piece further includes a circular gripping hole, the inner wall thereof is provided with a plurality of bulged gripping portions and a groove. The socket is provided with an engaging portion having a set of notches corresponding to the gripping portions within the gripping hole, and therefore, as the wrench is applied on a screwed object, the socket will not idle as the wrench is being rotated. The engaging portion of the socket is further provided with a retaining groove that can be coupled with the groove within circular gripping hole, using a C-shaped retaining plate. Thereby, the socket will not fall off the wrench easily.

However, the aforesaid socket wrench of the prior art has a drive piece that is not foldable with respect to the handle. Therefore, the drive piece of the wrench cannot be applied in many compact places where the handle is easily hindered by the surrounding obstacles.

SUMMARY OF THE INVENTION

Accordingly, the primary objective of the present invention is to provide a socket wrench for ratchet wheel sockets wherein the drive piece is foldable with respect to the handle, so that a user can apply the wrench in various operational occasions.

To achieve the above objective, a socket wrench for ratchet wheel sockets according to the present invention comprises a handle and a drive piece, which are pivotally connected by a retaining pin. The retaining pin is inserted through axial holes of the handle and a pivotal hole of a pivotal portion of the drive piece, so that the angular position of the drive piece with respect to the handle can be adjusted.

The socket wrench for ratchet wheel sockets thereby produced has the flexibility of changing the angular position of the drive piece so as to fit various operational occasions. For example, when the user has to operate the wrench from a higher position, he or she can drive the drive piece accordingly so that the handle is tilted upward for the user to grasp. As a second example, if the wrench has to be operated in a recess, the drive piece is adjusted into another suitable angular position so that surrounding objects will not block the handle.

The various objects and advantages of the present invention will be more readily understood from the following detailed description when read in conjunction with the appended drawings.

DETAILED DESCRIPTION OF THE PREFERRED EMBODIMENT

Figure 1:
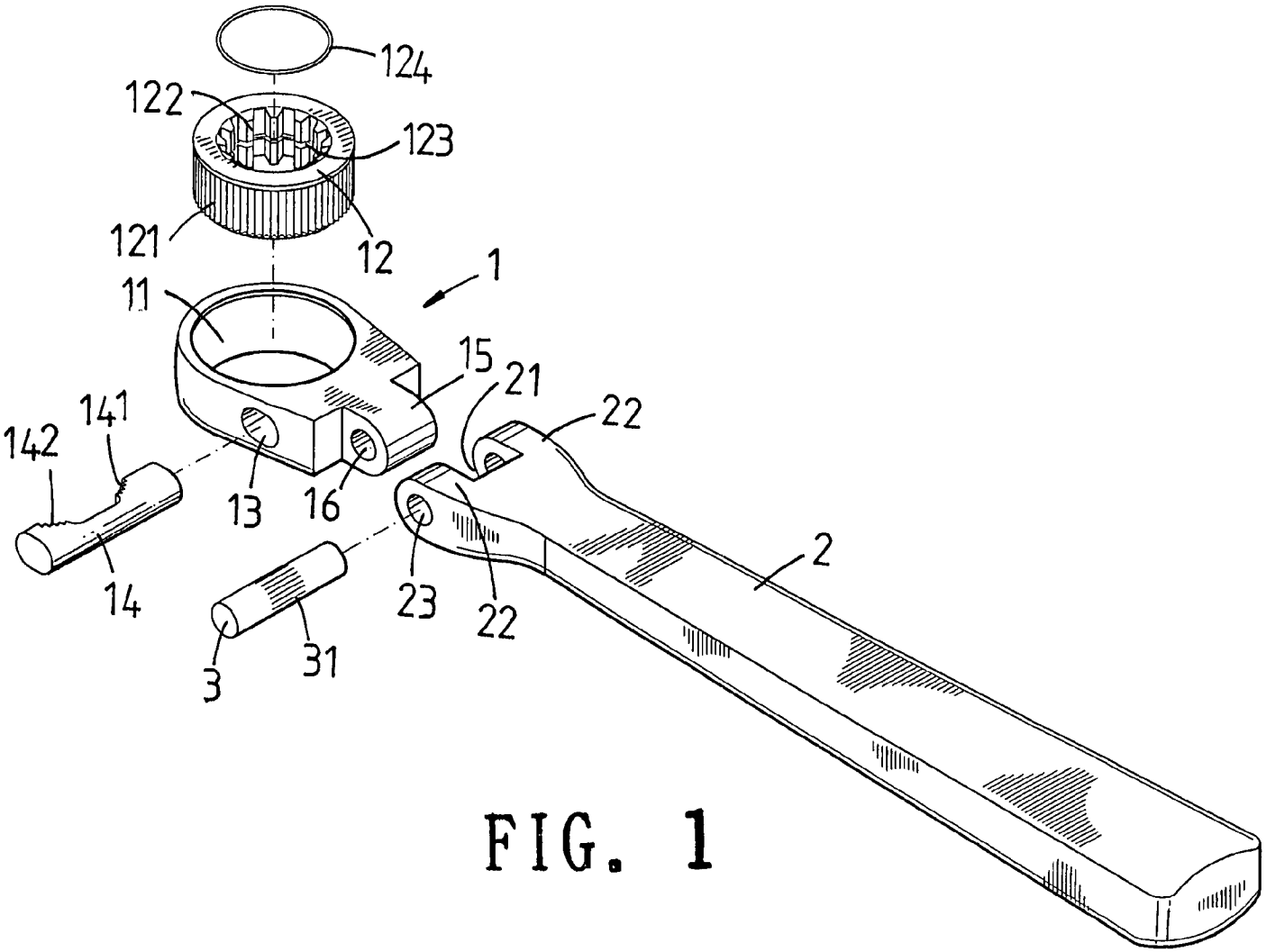
FIG. 1 is an exploded perspective view a socket wrench for ratchet wheel sockets according to the present invention.
Figure 3:
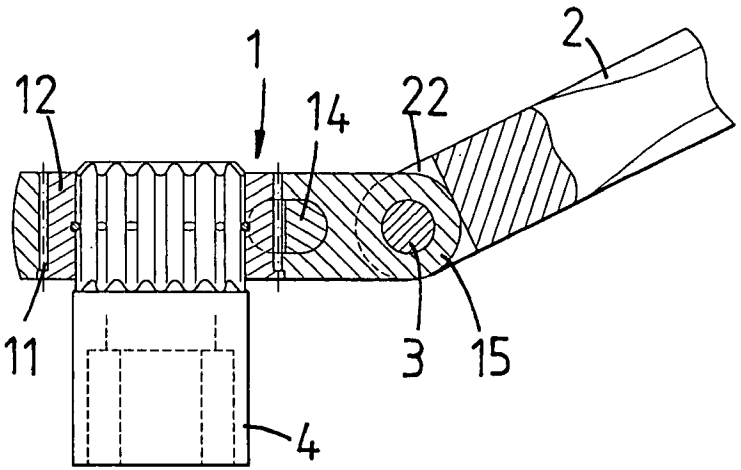
FIG. 3 is a lateral cross-sectional view of a socket wrench for ratchet wheel sockets wherein the drive piece is enlarged.
Figure 2:
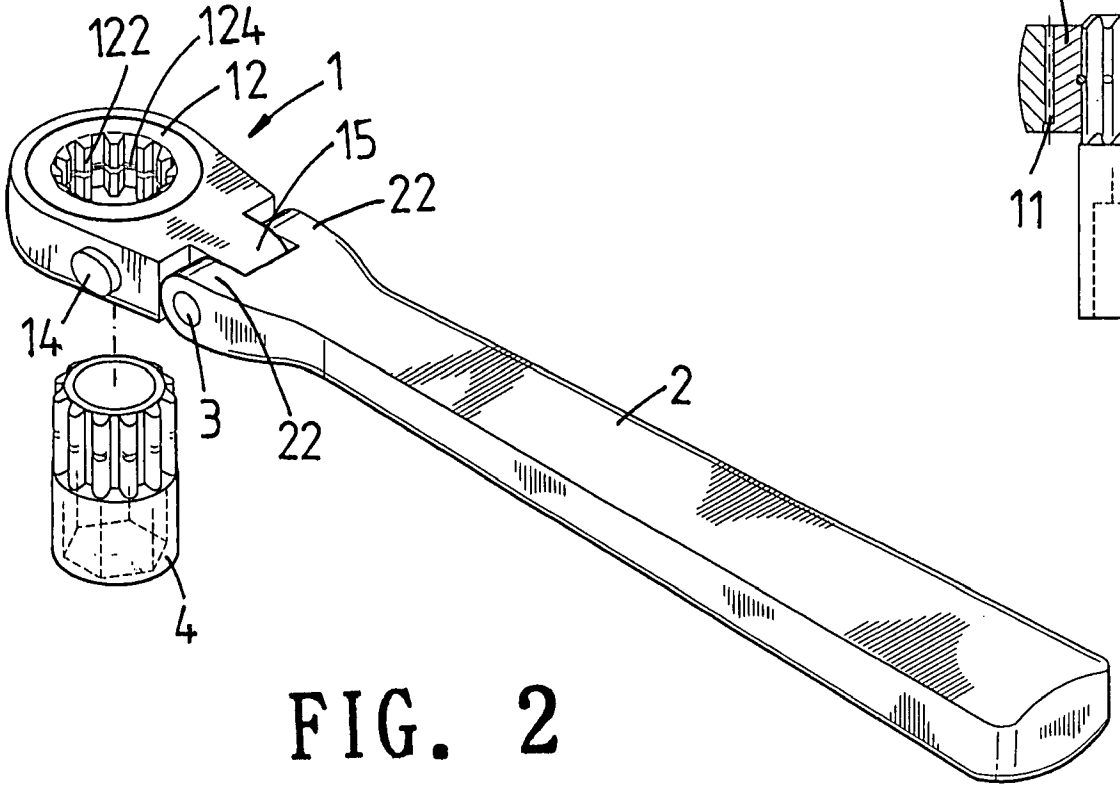
FIG. 2 is a perspective view a socket wrench for ratchet wheel sockets according to the present invention.
Figure 5:
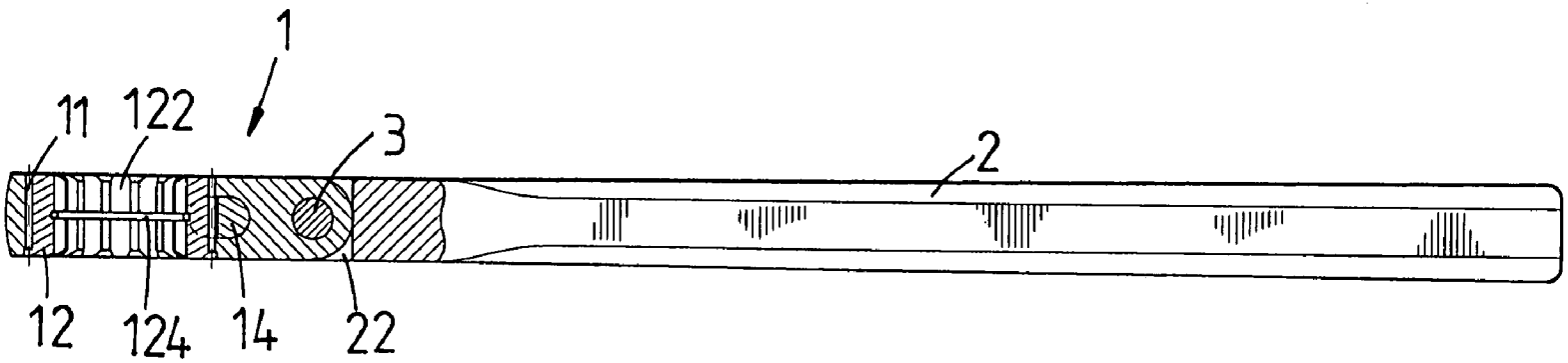
FIG. 5 is a lateral cross-sectional view of a socket wrench for ratchet wheel sockets according to the present invention.
Figure 4:
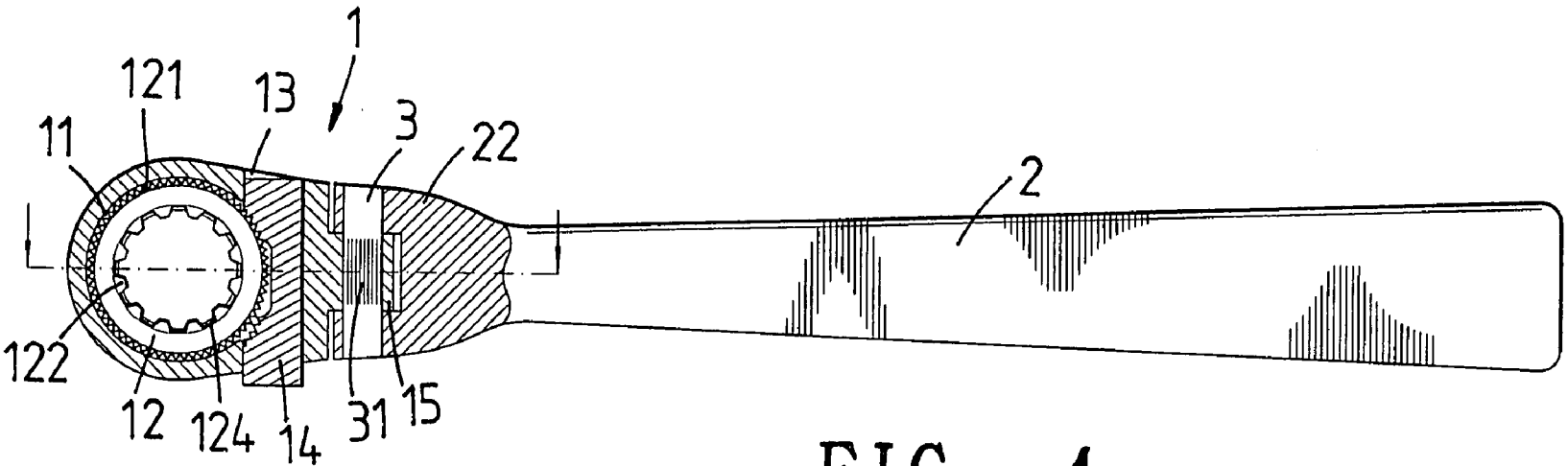
FIG. 4 is a top cross-sectional view of a socket wrench for ratchet wheel sockets according to the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIG. 1 to 5, a socket wrench for ratchet wheel sockets according to the present invention comprises a drive piece 1, a handle 2 and a retaining pin 3.

The handle 2 has one end provided with a recess portion 21, which is defined by the space between two ear portions 22. Each of the ear portions 22 is provided with an axial hole 23. The axial holes 23 are coaxial so that the retaining pin 3 can be inserted through the recess portion 21.

The drive piece 1 is provided with a receptacle hole 11 for retaining a ratchet wheel 12. The ratchet wheel 12 is substantially a hollow cylinder, wherein the outer wall is provided a multitude of teeth 121 and the inner wall is provided with a plurality of bulged gripping portions 122. The gripping portions 122 are divided into an upper half and a lower half by a groove 123. The groove 123 can house an O-shaped gripping plate 124 for retaining a socket 4. The drive piece 1 is further provided with a lock means that includes a through hole 13, being coaxial with the axis of the recess portion 21, and a locking pin 14. The through hole 13 is formed on the handle side of the receptacle hole 11, having a central section connected to the receptacle hole 11. The locking pin 14 is pivotally mounted within the through hole 13 and can slide along the through hole 13. The locking pin 14 is provided with a recessed central section that fits the circumference of the receptacle hole 11 and has a first teeth row 141 and a second teeth row 142; the teeth rows can be engaged with the teeth 121 on the outer wall of the ratchet wheel 12. The first teeth row 141 and the second teeth row 142 each restrict the rotation of the ratchet wheel 12 in a predetermined direction. To adjust the rotational direction for the ratchet wheel 12 to clockwise, the locking pin 14 is pushed to the left so that the first teeth row 141 is engaged with the ratchet wheel 12. Driving the wrench in the counterclockwise direction will result in decoupling between the ratchet wheel 12 and the drive piece 1, and therefore the ratchet wheel 12 will not move. On the other hand, to adjust the rotational direction for the ratchet wheel 12 to counterclockwise, the locking pin 14 is pushed to the right so that the second teeth row 142 is engaged with the ratchet wheel 12. Further, the handle side of the drive piece 1 is provided with connecting portion 15 for connecting the drive piece 1 to the recess portion 21 of the handle 2. The connecting portion 15 is provided with a pivotal hole 16 that is coaxial with the axial holes 23 of the ear portions 22, so that the retaining pin 3 can go through the pivotal hole 16 and the axial holes 23.

The retaining pin 3 is substantially a solid cylinder. The central section thereof is provided with a plurality of elongated longitudinal jogs 31. The retaining pin 3 is firstly inserted through the axial hole 23 of an ear portion 22, then the pivotal hole 16 of the connecting portion 15 and the axial hole 23 of another ear portion 22, so that the drive piece 1 is connected with the handle 2. Since the retaining pin 3 is pivotally movable in the pivotal hole 16 and the axial holes 23, the angular position of the drive piece 1 with respect to the handle 2 can be freely adjusted. The longitudinal jogs 31 on the retaining pin 3 further provide a necessary frictional effect for maintaining the adjusted angular position.

Figure 6:
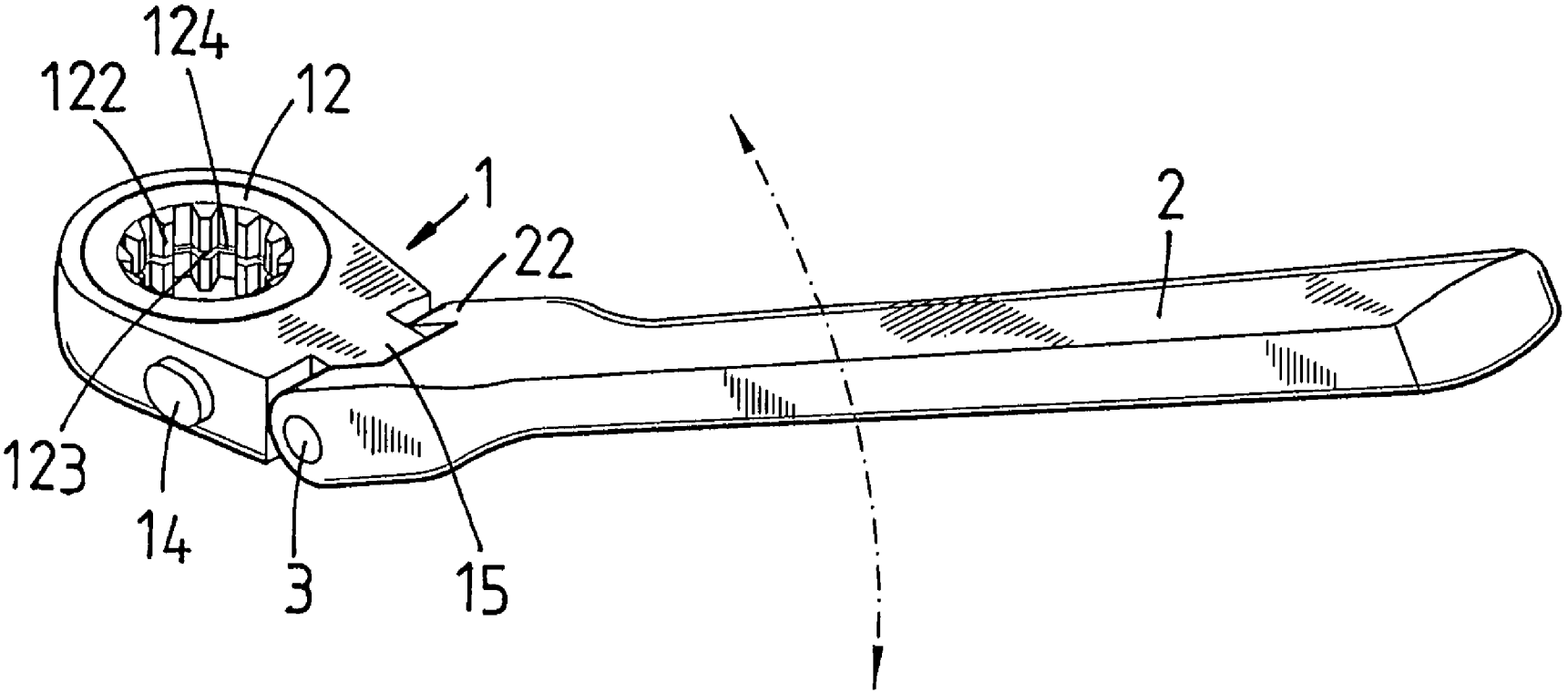
FIG. 6 is a perspective view of a socket wrench for ratchet wheel sockets wherein the drive piece is folded upward.
Figure 7:
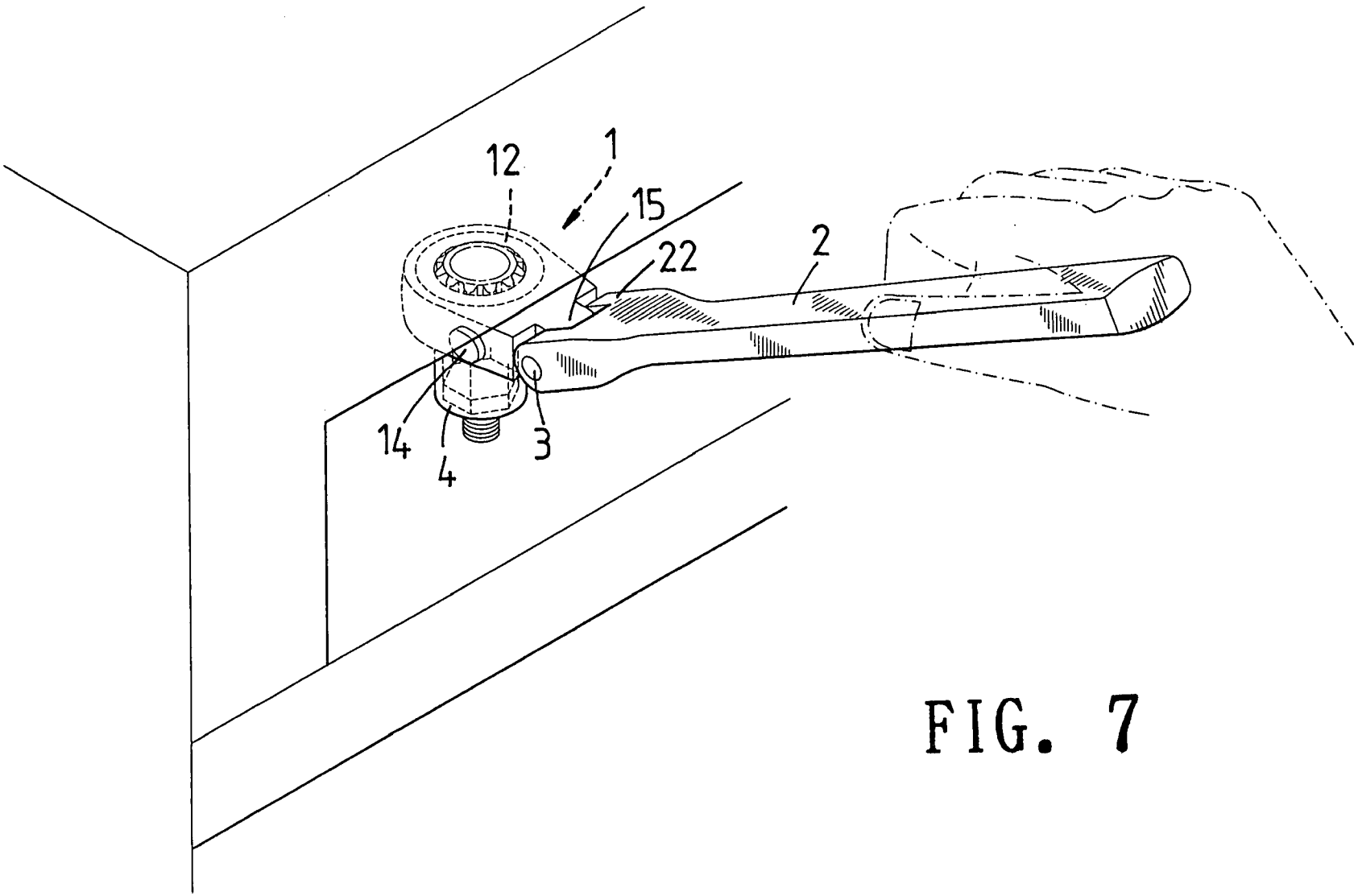
FIG. 7 illustrates the usage of a socket wrench for ratchet wheel sockets in a particular occasion.
Figure 8:
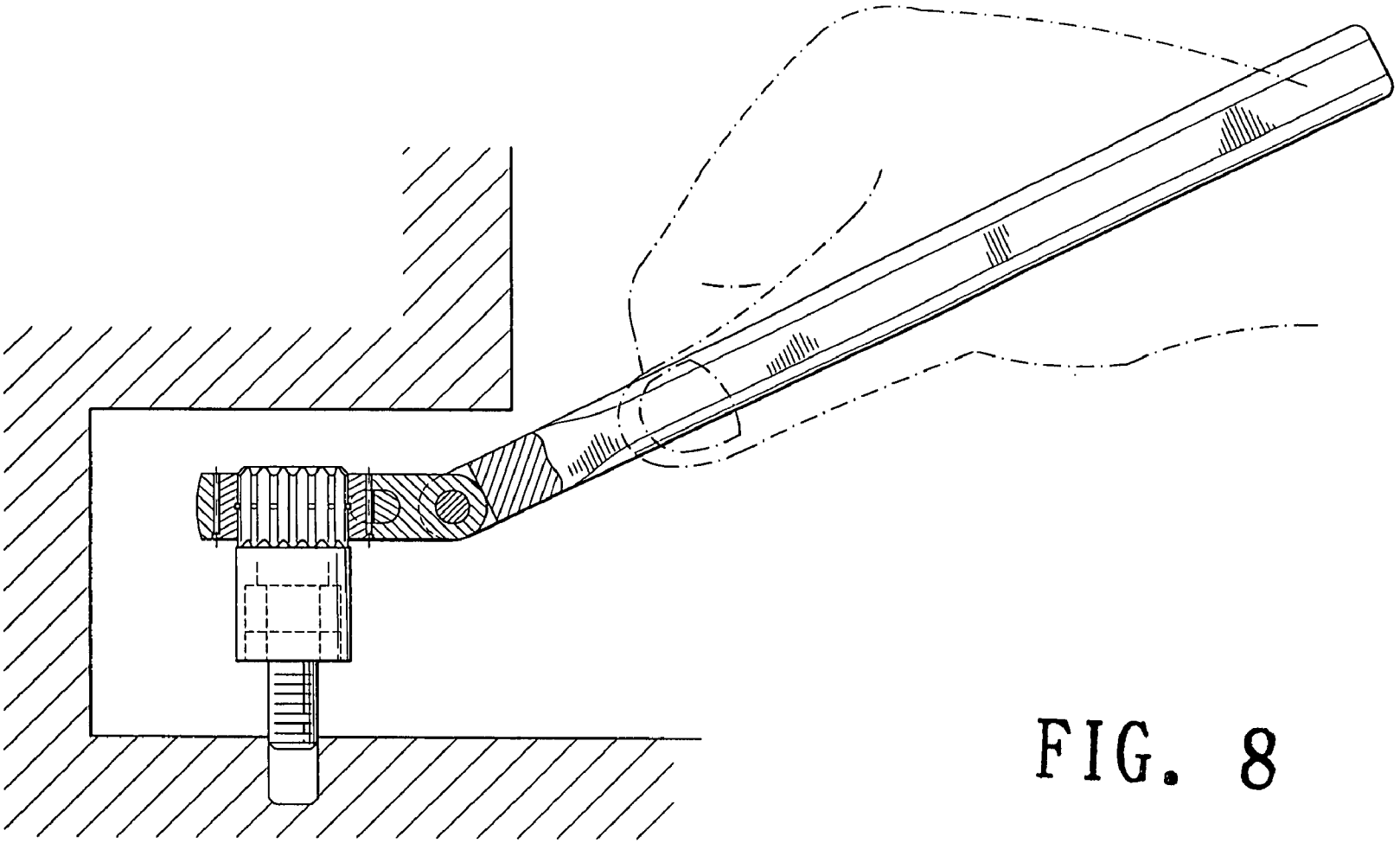
FIG. 8 is a cross-sectional view of the socket wrench for ratchet wheel sockets shown in FIG. 7.
Figure 9:
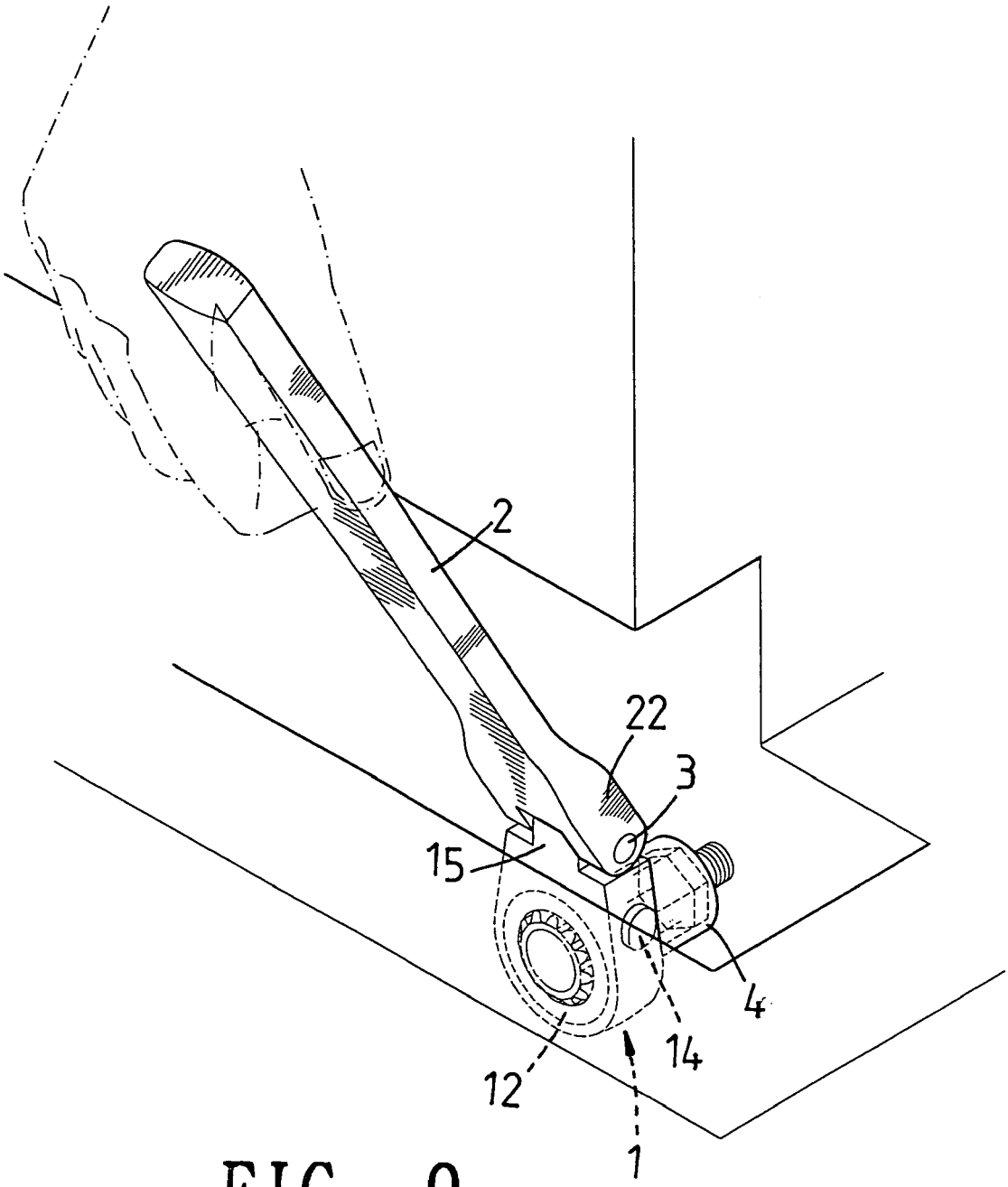
FIG. 9 illustrates the usage of a socket wrench for ratchet wheel sockets in another occasion.
Figure 10:
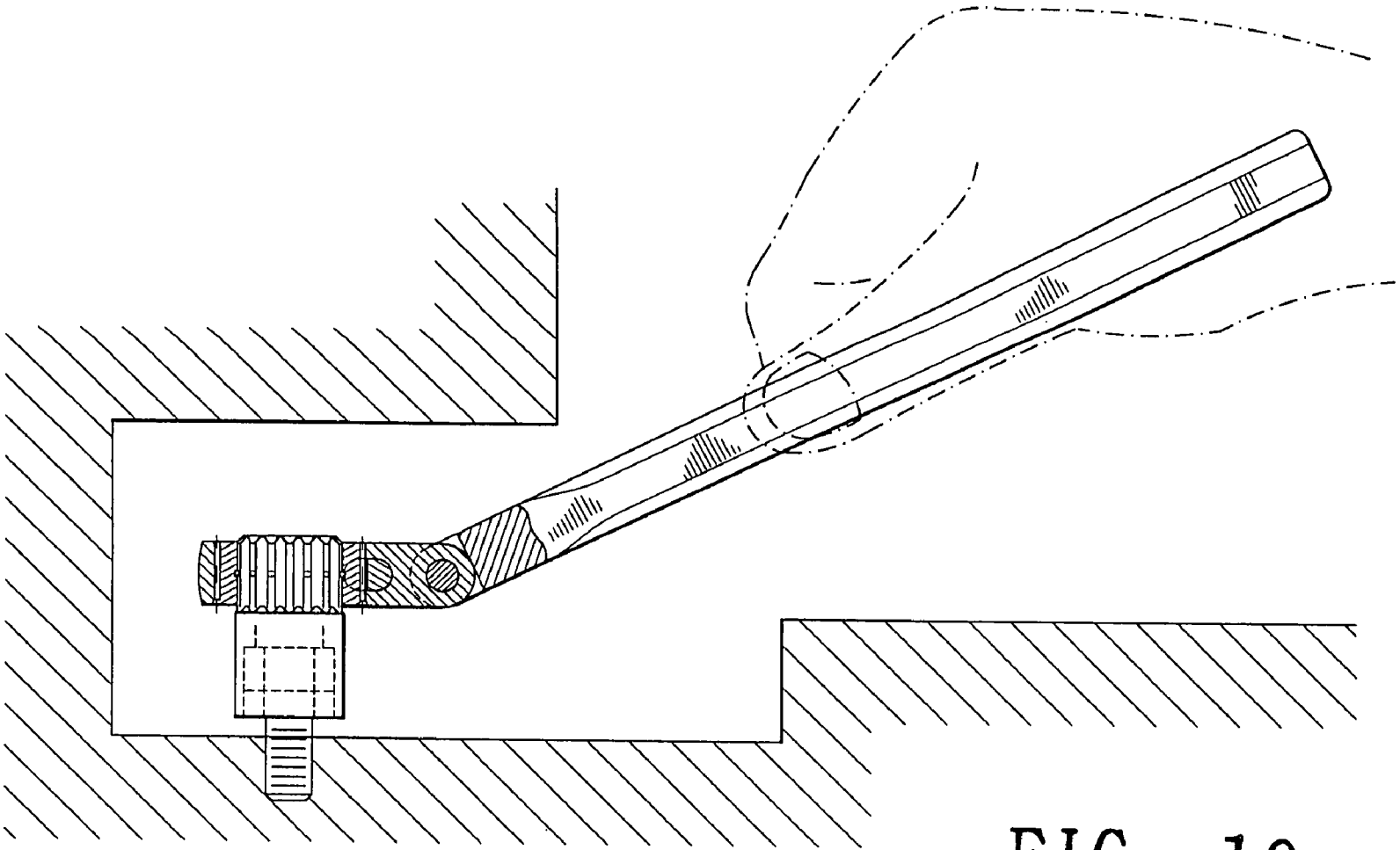
FIG. 10 is a cross-sectional view of the socket wrench for ratchet wheel sockets shown in FIG. 9.
Figure 11:
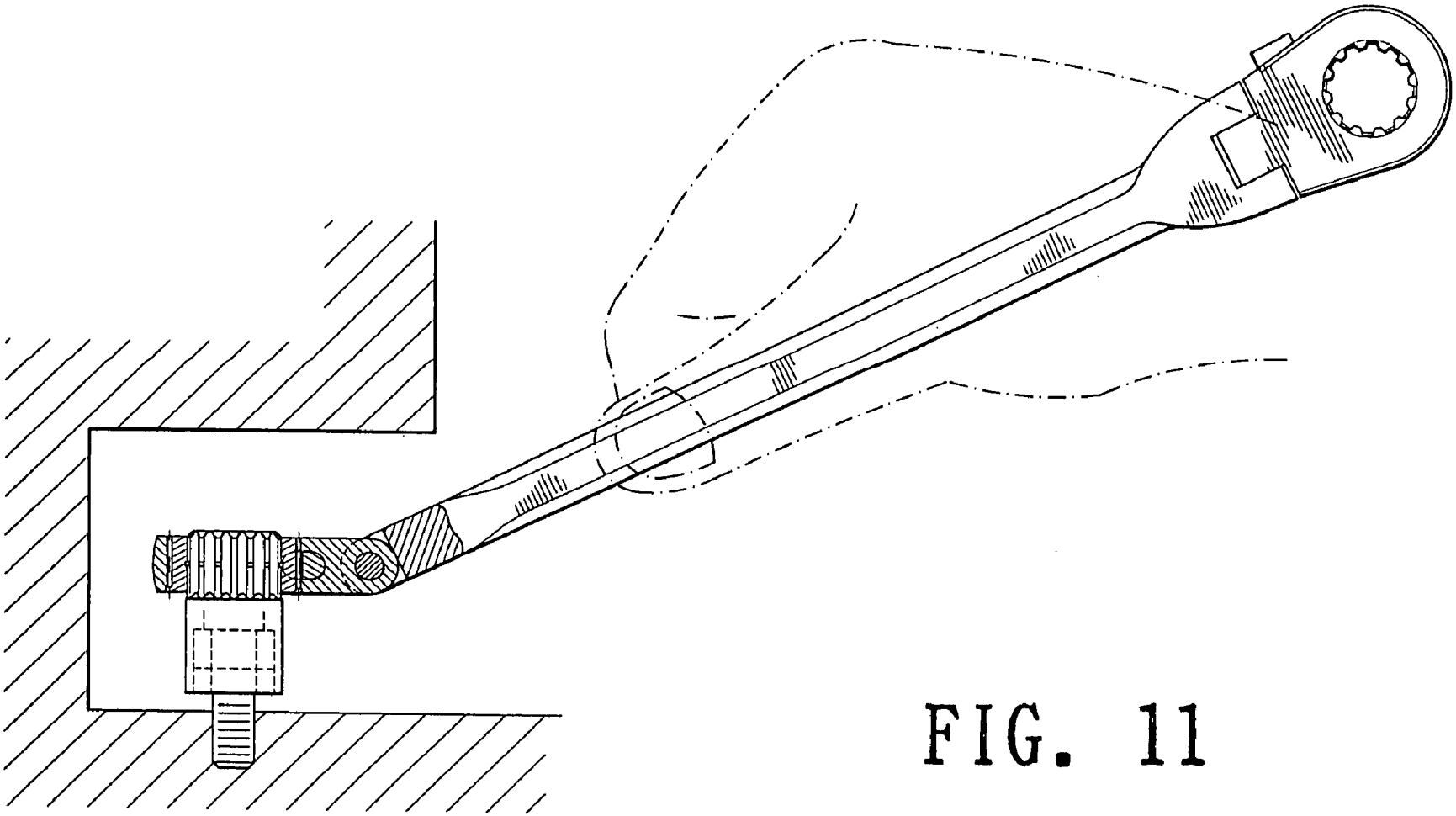
FIG. 11 is a cross-sectional view of the second preferred embodiment of the present invention.
Figure 12:
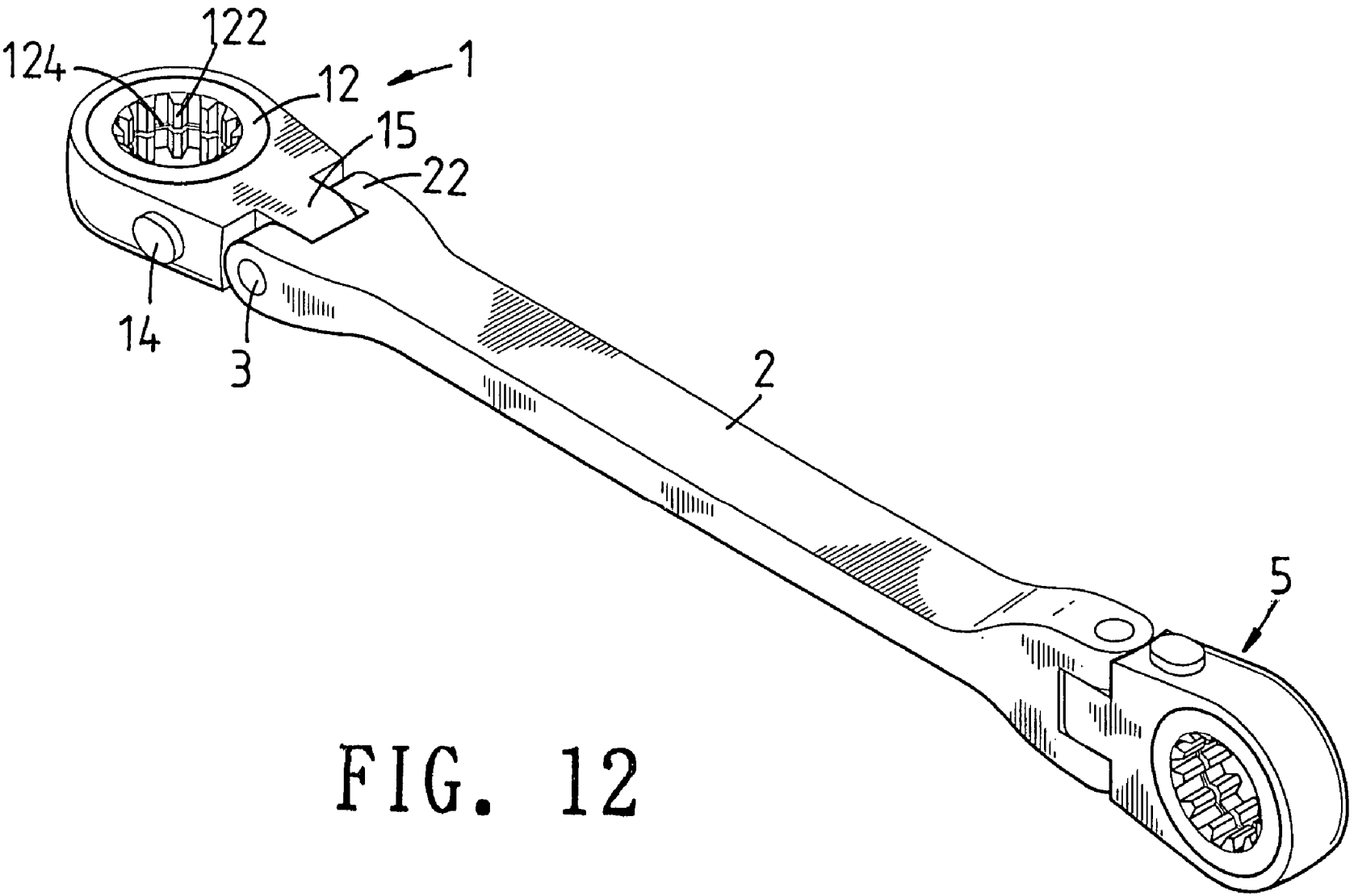
FIG. 12 is a perspective view of the second preferred embodiment of the present invention.
Figure 13:
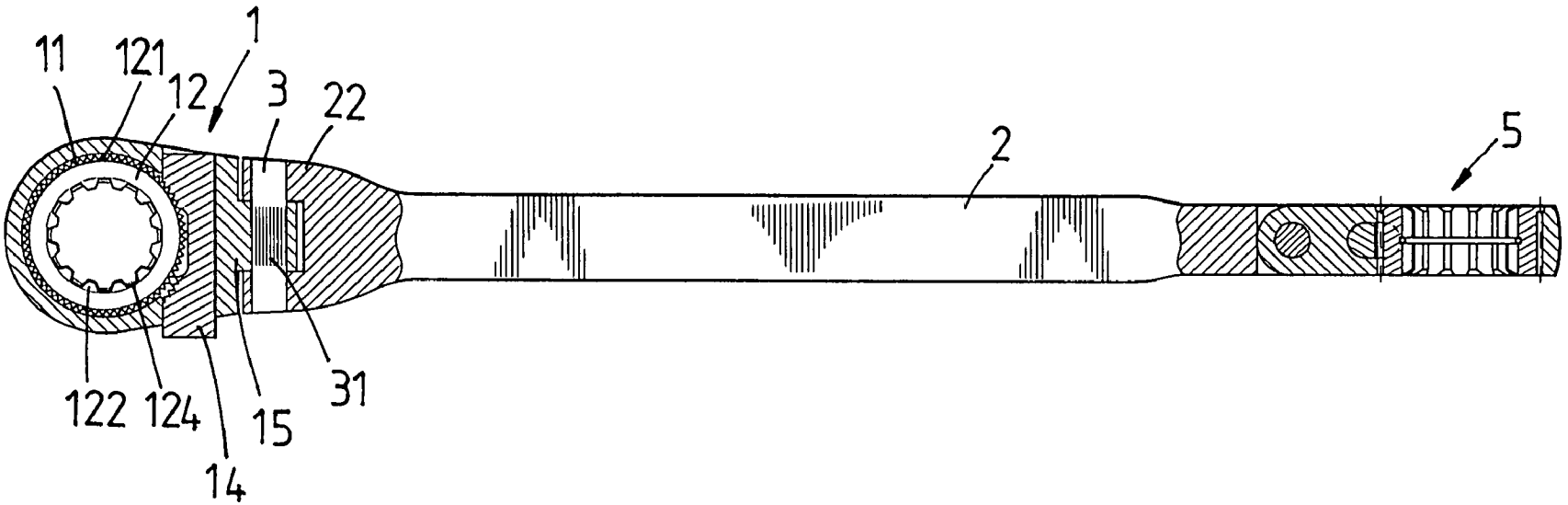
FIG. 13 is another cross-sectional view of the second preferred embodiment of the present invention.
Figure 14:
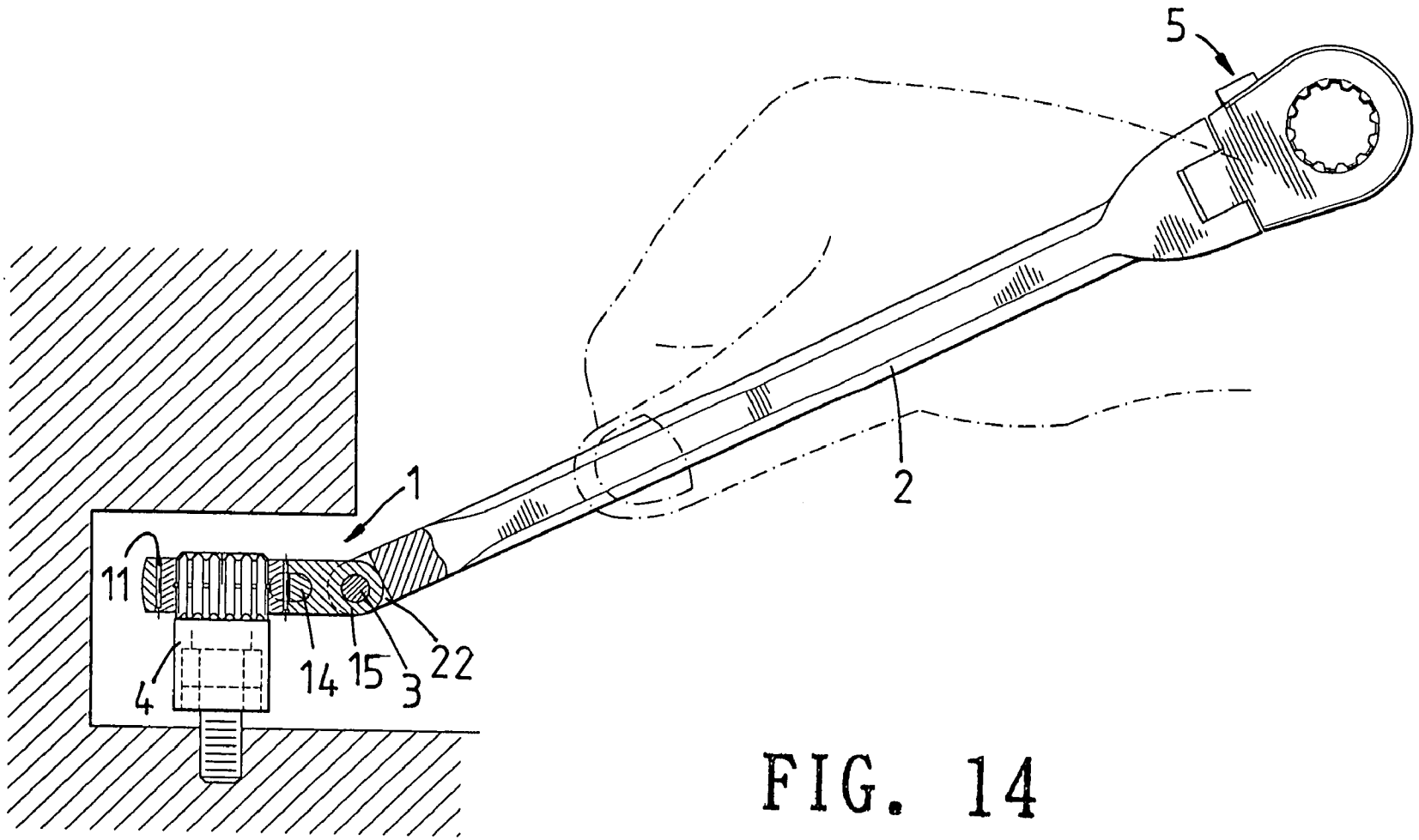
FIG. 14 illustrates the usage of the second preferred embodiment of the present invention in a particular occasion.

Referring to FIG. 6, the socket wrench for ratchet wheel sockets has the flexibility of changing the angular position of the drive piece 1 so as to fit various operational occasions. As shown in FIGS. 7 and 8, when the user has to operate the wrench from a higher position, he or she can bend the drive piece 1 a little so that the handle 2 is tilted upward for the user to grasp. As shown in FIGS. 9 and 10, the wrench has to operate in a recess. The drive piece 1 is adjusted into a suitable angular position so that surrounding objects will not block the handle 2.

Referring to FIG. 11 to 14, the second preferred embodiment of the present invention is a socket wrench for ratchet wheel sockets having a second drive piece 5. The structure of the second drive piece 5 is the same as the first drive piece 1. The driving axes of the first drive piece 1 and the second drive piece 5 are perpendicular to each other.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A socket wrench for ratchet wheel sockets, comprising: a handle having a first and a second recess at a first terminal thereof, a first empty space between a pair of first ear portions defining said first recess, each of said first ear portions being provided with an axial hole; a first drive piece for retaining a first ratchet wheel on which a ratchet wheel socket can be mounted, said recess of said handle receiving a pivotal portion of said first drive piece; and a first retaining pin for connecting said handle and said first drive piece by being inserted though said axial holes of said first ear portions and said pivotal portion of said first drive piece; a second empty space between a pair of second ear portions defining said second recess, each of said second ear portions being provided with an axial hole; a second drive piece for retaining a second ratchet wheel on which a ratchet wheel socket can be mounted, said recess of said handle receiving a pivotal portion of said second drive piece; and a second retaining pin for connecting said handle and said second drive piece by being inserted though said axial holes of said second ear portions and said pivotal portion of said second drive piece; wherein driving axes of the first drive piece and the second drive piece are perpendicular to each other; whereby each said drive piece can be folded about a respective one of said retaining pins to change the angular position of said drive piece with respect to said handle.

2. The socket wrench for ratchet wheel sockets of claim 1 wherein said drive piece has a lock means for switching the rotational direction of said ratchet wheel of said drive piece.

3. The socket wrench for ratchet wheel sockets of claim 1 wherein said retaining pin is provided with a plurality of elongated longitudinal jogs for providing a frictional effect on said drive piece so that a selected angular position can be maintained.

4. The socket wrench for ratchet wheel sockets of claim 1, wherein at least one of the first and second driving pieces is provided with a receptacle hole for retaining one ratchet wheel; the ratchet wheel being a hollow cylinder, an outer wall thereof is provided a with plurality of teeth and an inner wall thereof is provided with a plurality of bulged gripping portions; the gripping portions are divided into an upper half and a lower half by a groove; the groove being housed with an O shaped gripping plate for retaining a socket.

5. The socket wrench for ratchet wheel sockets of claim 4, wherein the drive piece is further provided with a lock means that includes a through hole, being coaxial with the axis of the recess portion, and a locking pin; the through hole being formed on the handle side of the receptacle hole, having a central section connected to the receptacle hole; the locking pin being pivotally mounted within the through hole and can slide along the through hole; the locking pin is provided with a recessed central section that fits the circumference of the receptacle hole and has a first teeth row and a second teeth row; the teeth rows being engaged with the teeth on the outer wall of the ratchet wheel; the first teeth row and the second teeth row each restrict the rotation of the ratchet wheel in a predetermined direction.

* * * * *